United States Patent [19]

Schmanski et al.

[11] Patent Number: 4,605,204

[45] Date of Patent: Aug. 12, 1986

[54] COLLAPSIBLE RECREATIONAL FENCE

[75] Inventors: Donald W. Schmanski; Scott Landis, both of Carson City, Nev.

[73] Assignee: Carsonite International Corporation, Carson City, Nev.

[21] Appl. No.: 639,629

[22] Filed: Aug. 13, 1984

[51] Int. Cl.[4] ..... E04H 17/14

[52] U.S. Cl. ..... 256/19; 256/13.1; 404/10

[58] Field of Search ..... 256/19, 1, 48, 45, 13.1; 404/10

[56] References Cited

U.S. PATENT DOCUMENTS

| | | | |
|---|---|---|---|
| 1,407,540 | 2/1922 | Holsinger | 256/48 |
| 2,785,897 | 3/1957 | Lennon | 256/1 X |
| 3,776,522 | 12/1973 | Bartlett | 256/19 X |
| 4,061,435 | 12/1977 | Schmanski et al. | 256/1 X |
| 4,084,914 | 4/1978 | Humphrey et al. | 256/1 X |
| 4,092,081 | 5/1978 | Schmanski | 404/10 |
| 4,290,712 | 9/1981 | Hayes | 404/10 |

*Primary Examiner*—Andrew V. Kundrat

*Attorney, Agent, or Firm*—Calvin E. Thorpe; Vaughn W. North; M. Wayne Western

[57] ABSTRACT

A collapsible fence structure suited for recreational application such as baseball outfield fencing and the like, comprising a flexible, resilient, plastic fence mesh attached to fiber reinforced plastic support posts which are adapted to deflect under the weight of impact of an individual falling against the fence and being operable to immediately restore to an original, upright condition without causing injury to the individual or damage to the fence structure.

7 Claims, 6 Drawing Figures

COLLAPSIBLE RECREATIONAL FENCE

BACKGROUND OF THE INVENTION

1. Field of the Invention

This invention pertains to a fence useful in sports where impact between athletes and the fence is a likely event. More specifically, the invention pertains to a fence structure which deflects upon impact of an athlete to prevent injury of the athlete upon impact.

2. Prior Art

Many sports utilize fence-like structures to define the perimeter of play. For example, a baseball diamond includes an outfield which is bounded by a fence or wall. If a batter can drive the baseball beyond the wall, he scores a homerun. Accordingly, a baseball player will frequently jump to retrieve a ball which is likely to go over the fence but which can be reached if the skill and timing of the fielder are correct.

Such circumstances give rise to probable impact of the fielder at the wall or fence because the player is usually running toward the fence when he realizes that the ball is sufficiently high for a homerun. Obviously, where the fence is made of rigid materials, injury is forseeable. The fielder must therefore balance the liklihood of catching the ball versus the risk of injury against the fence. Misjudgment may either result in unnecessary reluctance of the player against fielding a ball which turned out to be beyond the reach of the player. These problems are even more serious for young and inexperienced players, and particularly with Little League organizations. Children are particularly vulnerable where they lack experience in judging between safety and satisfying the enthusiasm of spectators.

Some attempts have been made to use plastic mesh or fence material in combination with thermoplastic tubes as fence poles. Because of the weight of the fence, however, the thermoplastic materials have not been suitable. In addition to allowing the fence material to sag, they lack the resilience to restore the fence to its upright configuration after deflection under impact.

OBJECTS AND SUMMARY OF THE INVENTION

It is therefore an object of the present invention to provide a recreational fence which is capable of deflecting under impact of an athlete, yet having sufficient resilience to restore itself upright after the impact despite the weight of the fence material.

It is a further object of the present invention to provide a recreational fence which does not result in injury to an athlete falling against the fence.

A still further object of this invention is to provide a method of construction for a deflectable fence structure suitable for uses in areas of frequent impact where deflection of the fence structure is preferable over injury or damage to the impacting body.

These and other objects are realized in a collapsible fence structure which comprises a substantial length of flexible, resilient plastic fence mesh which is tied or otherwise affixed to fiber reinforced plastic posts. These posts are characterized in that they exhibit concurrent driveability and flexibility characteristics wherein the product of elastic modulus and moment of inertia for the post is chosen such that it withstands buckling loads applied to the top of the post which permits nondestructive deflection of the post upon impact by a moving object, with subsequent immediate restoration to its original, upright condition. The mesh and rigid plastic posts are attached to form a unified fence structure which is maintained in vertical orientation by this support post, except under conditions of impact. In such cases, the mesh and support posts deflect and allow the impacting body to pass over the fence without causing damage to either. The fiber reinforced plastic post has sufficient resilience to return the fence to its upright orientation and to maintain this proper orientation even in wind and other adverse natural conditions. Various configurations are shown, along with the method of installation.

Other objects and features of the present invention will be apparent to those skilled in the art based upon the following detailed description, taken in connection with the following drawings:

FIG. 1 shows a frontal view of the subject collapsible fence positioned in the ground.

FIGS. 2(*a*), 2(*b*) and 2(*c*) illustrate the operation of the collapsible fence upon impact of a baseball player.

DETAIL DESCRIPTION OF THE INVENTION

Figure 1:
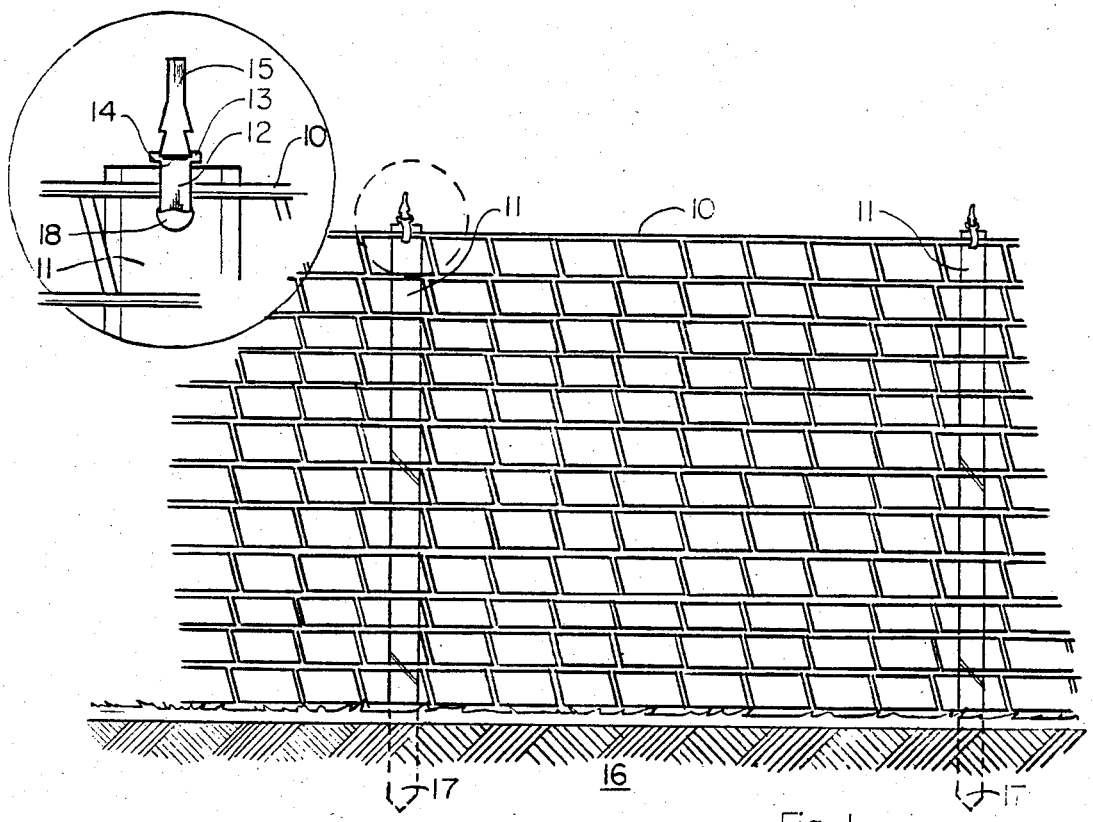

A preferred embodiment of a collapsible fence structure specifically adapted for use in recreational applications such as baseball outfield fencing, crowd control and recreational areas and playground fencing is shown in FIG. 1. This fence comprises a substantial length of flexible, resilient, plastic fence mesh 10 which attached to at least two fiber reinforced plastic support posts 11. The fence mesh 10 is attached to the support post 11 by a tie 12 which provides means for attaching the mesh to the plastic post to form a unified fence structure.

The plastic fence mesh used in connection with the subject invention needs to be light in weight, yet have sufficient strength to support the weight of an individual falling against the fence as the fence is in its vertical orientation. If the fence material did not have sufficient strength, it might break upon impact and result in injury to the player as he strikes the ground. The function of the fence mesh is to transfer the momentum of the impacting object through the resilient fence structure into the support post. This post 11 then deflects to the extent necessary to dissipate the impact energy.

Numerous types of fence mesh material may be used in accordance with the teachings of this invention. For example, Flasher Handling Corporation of Buffalo, New York manufactures a plastic fence substantially as shown in the drawings which meets the requirements of strength, resilience and flexibility set forth above. This material is lightweight, an average 50 foot roll of 5 foot high fence weighs only 26 pounds. Excessive weight of the fence mesh would tend to cause the unified fence structure to sag in the wind or otherwise have difficulty returning to a vertical orientation after impact or other cause of deflection.

Figures 2A, 2B, 2C:
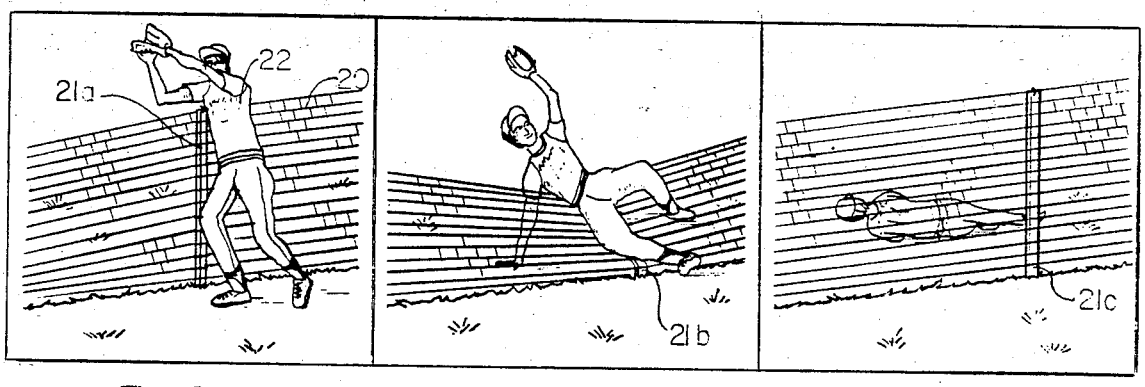

In addition to weight and strength factors, selection of fencing mesh also involves the proper choice of mesh size openings. A larger mesh size will decrease wind resistance and will provide for reduced weight. On the other hand, if the object of use for the collapsible fence is as an obstacle for snow, leaves, blowing papers or debris, smaller mesh may be desirable. The latter applications, of necessity, involve use of a more rigid support post, such as that illustrated in FIGS. 1 and 3. For typical recreational field applications, a high density polyethelyne fence mesh having mesh openings of approximately 2" square has proven satisfactory. Such fencing material is available having a strength of 1885 PSI and impact strength of 12 foot-pound. This fence mesh material is illustrated in FIG. 2. FIG. 1 illustrates a rhombus configuration also made of high density polyethelyne.

Although the use of plastic fence mesh has been attempted with thermoplastic polymer support posts, such prior art fence structures have not been acceptable. This has been primarily due to the lack of rigidity and resilience in the thermoplastic posts. Although such materials provided initial satisfactory performance, constant loading of the wind or frequent impacts weakened the thermoplastic structure and resulted in a sagging or non-operational fence. In other instances, the weight of the fence mesh itself was sufficient to deflect the thermoplastic posts and frustrate the function of the fence structure. Accordingly, the combination of thermo-plastic support posts and plastic fence mesh has experienced repeated and ongoing failure as a fence structure.

A primary feature of the present invention is the observation that thermosetting resin with fiber reinforcement provides sufficient resilience to bear the load of both (i) the substantial weight of the fence material and (ii) the impact loading that can repeatedly occur. The first loading resulting from weight of the fencing material is a continuous influence which in prior art structures has tended to gradually overcome the resilience of thermoplastic materials used in support posts. The present inventors have discovered that the fiber reinforced thermosetting resins are capable of indefinitely supporting the weight of the fence mesh, even as it is buffeted by wind and other natural factors.

More importantly, by constructing the fiber reinforced support posts such that the post is capable of withstanding buckling loads applied at the top of the post by a post driver during installation as well as concurrent elastic character in which the exposed section of the post is able to nondestructively deflect upon impact by a moving object, with subsequent immediate restoration to an original, upright condition, a stable, resilient fence structure can be achieved. These concurrent characteristics of rigidity in the support post to bear the weight of the fence weight and other loading forces, along with the flexibility to deflect upon impact by a moving object such as a baseball player, can be defined in terms of concurrent driveability and flexibility characteristics.

Figure 5:
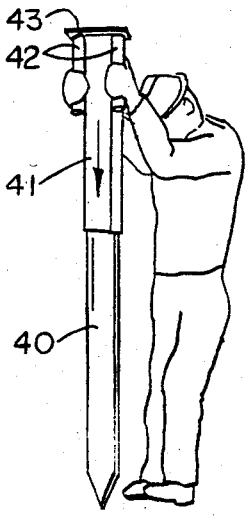
FIG. 5 illustrates the method of installation using a driving tool to install the post.

As used herein, driveability refers to the inherent structural rigidity of the post along its longitudinal axis to allow its insertion into the ground by use of a conventional driving instrument as illustrated in FIG. 5. This column rigidity is sufficient to allow the post to be driven into the ground without preparation of the soil by digging a hole and backfilling the hole as was customary with the prior thermoplastic posts. Where the soil is extremely hard and rocky, a starter hole may be necessary to provide initial support for the base of the post.

Rather than attempting to define the "rigidity" factor in terms of ability of the post to support fence weight, the present invention defines "rigidity" in the context of being able to indure installation by driver directly into the soil. Where the post has sufficient stiffness to be installed by this driving technique, it has been found that this post would have sufficient strength to support the plastic fence mesh in accordance with the teachings of this invention. This definition of column rigidity based on driveability is also convenient in view of the fact that the preferred method of installation involves use of a driver which makes the fence installation quick and convenient.

To achieve concurrent driveability and flexibility in the same post, the present invention utilizes a fiber reinforced plastic highway delineation device such as is disclosed in U.S. Pat. No. 4,092,081. That patent discloses a highway delineation device which is capable of being installed in hard ground by a driving tool, yet capable of surviving high speed vehicle impacts without losing its original orientation and condition. The present invention makes the observation that this structure is capable of meeting the unique requirements of a collapsible fence capable of supporting plastic fence mesh yet responsive to impact of a baseball player or the like without injury. Indeed, the dynamics of fence structure response are surprisingly compatible with a dispersion of force and resilience to allow the impacting object to pass over the fence without injury to either the object or the fence structure. This unusual result occurs where the driveability and flexibility characteristics are developed within the support post 11 by selection of appropriate material represented by elastic modulus E and geometric cross-section represented by moment of inertia I to provide the previously described driveability and flexibility characteristics. Further description of the construction of the support post beyond that disclosed in U.S. Pat. No. 4,092,081 is deemed unnecessary.

The specific dynamics of the collapsible fence are illustrated in FIGS. 2(*a*), 2(*b*) and 2(*c*). As shown, a baseball player 22 is attempting to field a flyball which is about to go over the outfield fence. This fence is constructed of a fence mesh 20 which is attached to a resilient plastic post 21 in accordance with the present invention. As player 22 impacts against the fence, the support post 21(*a*) begins to deflect. FIG. 2(*b*) illustrates the momentum of the player being transferred to the fence and support post 21(*b*) without dangerous impact or injury. FIG. 2(*c*) illustrates conditions after the player has rolled over the fence and is free of its structure without injury. Support post 21(*c*) is now in its original, upright condition.

Figure 3:
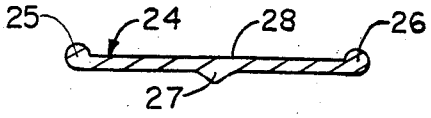
FIG. 3 shows a cross-sectional view of a support post taken perpendicular to the longitudinal axis thereof.
Figure 4:
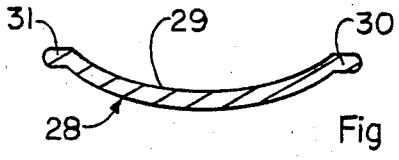
FIG. 4 shows a cross-sectional view of an additional embodiment of a support post taken perpendicular to the longitudinal axis thereof.

The amount of stiffness in the support post is a factor of the elastic modulus E and moment of inertia I as previously discussed. FIG. 3 shows the preferred cross-section of the support post having a high degree of stiffness to provide greater resilience and stability to the fence structure. This increased stiffness arises by virtue of projecting ribs 25, 26 and 27 which are heavily loaded with longitudinal roving or reinforcing fiber. This structure increases E because of the high modulus of the glass fiber or other reinforcing material, and also increases I because of the projecting structure from the neutral axis of this cross-section. As this structure deflects, the forward ribs 25 and 26 and the backward rib 27 each shift slightly toward the neutral axis to decrease moment of inertia I and increase the flexibility of the post. This enables the impacting object to bend the post without succeeding elastic limits for the material or otherwise damaging the post or object. FIG. 4 illustrates a less rigid cross-section 28 wherein the forward surface 29 is concave and the rearward surface is convex. Ribs 30 and 31 are provided to improve the stiffness of the post so that the weight of the fence can adequately be borne. The concavo-convex structure of FIG. 4 is suitable for fences of lower height weight. For fence structures of 4 feet or more in height, the more rigid structure of FIG. 3 is preferrable.

Figure 6:
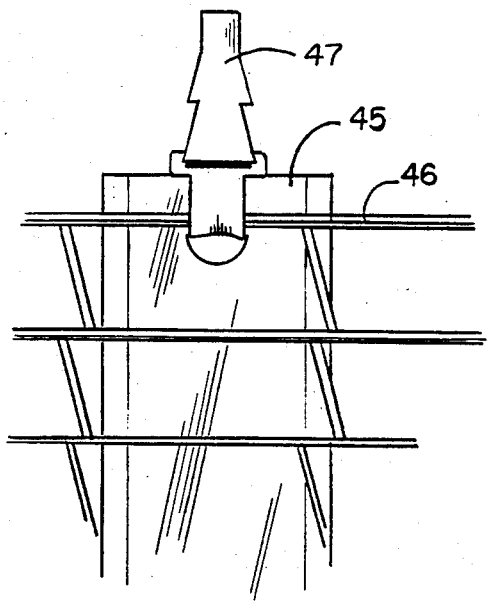
FIG. 6 illustrates one method of attachment of the fence mesh to the support post.

The method of construction of the subject collapsible fence is shown in FIGS. 5 and 6. This method consists of driving a plurality of fiber reinforced plastic support post 40 into the ground where the fence is to be positioned. The posts are driven into the ground using a driving device 41 which encloses an upper portion of the post and aligns the impact force from the impact cap 43 in proper orientation at the top of the post. Handles 42 are provided on the driving device to assist in the up and down motion required to drive the post into the ground.

The post is driven into the ground to a sufficient depth to provide rigid vertical support for the attached fence. This support must exist despite the occurrance of an impact which could cause the post to substantially deflect from its vertical orientation. In other words, upon such an impact, the post should not be pulled from its fixed position in the ground. For permanent installations, a typical post of 5 to 6 feet, should be driven into the ground a distance of at least 16 inches and preferably 18 to 24 inches. By installing the post to this depth, frictional force from the surrounding soil will retain the post in the ground despite frequent and substantial impact force. Where the installation is only temporary, the post should be driven to a depth of at least 5 inches and preferably 6 to 8 inches. Once the post 45 (FIG. 6) is properly positioned in the ground, a length of plastic fence mesh 46 is positioned against the upright post. The mesh is affixed to the support post by use of a tie 47 which secures the two elements together. FIG. 6 illustrates a tie 47 being applied through the mesh opening and a correspondingly positioned hole in the post. An additional tie would be secured at a medial length of the post, and an additional tie at the base of the post. It will be apparent to those skilled in the art that other means of attaching the mesh to the support post would serve equally well to provide a unified fence structure in accordance with the present invention.

The present invention combines the durability of fiber-reinforced plastic and the convenience of driveability for support posts to yield a safe fence structure which provides the necessary definition of boundaries presently provided by metal fences, yet without the risk of injury upon objects or persons colliding with such fences. Applications of this collapsible fence are ideal for baseball and other recreational parks, channeling skiers at resorts, crowd control in recreational areas such as golf courses and amusement parks, and numerous other applications where impact is forseeable between persons and the surrounding fence structure.

I claim:

1. A collapsible fence structure specifically adapted for use in recreational applications such as baseball outfield fencing, crowd control in recreational areas and playground fencing, said fence structure comprising:

a substantial length of flexible, resilient, plastic fence mesh capable of supporting a person when such person falls against the mesh in its vertical orientation;

at least two fiber-reinforced plastic support posts characterized in that each post has concurrent driveability and flexibility characteristics wherein the product of EI (E=elastic modulus; I=moment of inertia) for the post is chosen such that it withstands buckling loads applied at the top of the post by a post driver during installation and that it establishes elastic character in an exposed section of the post to permit non-destructive deflection of the post upon impact by a moving object and subsequent immediate restoration to an original, upright condition;

means for attaching the mesh to the plastic posts to form a unified fence structure which is maintained in vertical orientation by the support post except under conditions of impact, whereupon the mesh and support post deflect and allow the impacting body to pass over the fence, said fence structure thereafter being restored to its vertical orientation by the support post.

2. A collapsible fence structure as defined in claim 1 wherein the posts are adapted to be driven into the ground to a depth of at least five inches for temporary installation.

3. A collapsible fence structure as defined in claim 1 wherein the posts are adapted to be driven into the ground to a depth of at least sixteen inches for permanent installation.

4. A collapsible fence structure as defined in claim 1 wherein the posts include a small opening at a top portion thereof adapted to receive the means for attaching the mesh to the post, said attaching means comprising a durable tie adapted to anchor the mesh firmly to the top of the post.

5. A fence structure as defined in claim 1, wherein the fence mesh is approximately four feet in height and the posts are from approximately fifty-two to seventy inches in length, depending upon whether the installation is to be temporary or permanent.

6. A method of fencing a recreational area without creating a risk of injury or damage to objects which fall against the fencing structure, comprising:

a. driving a plurality of fiber-reinforced plastic support posts into ground where the fence is to be positioned, said posts being driven into the ground to a sufficient depth to provide rigid vertical support to the post despite the occurrance of an impact would cause the post to substantially deflect from its vertical orientation, said post being characterized in that each post has concurrent driveability and flexibility characteristics wherein the product of EI (E=elastic modulus; I=moment of inertia) for the post is chosen such that it withstands buckling loads applied at the top of the post by a post driver during installation and that it establishes elastic character in an exposed section of the post to permit non-destructive deflection of the post upon impact by a moving object and subsequent immediate restoration to an original, upright condition;

b. positioning a length of flexible, resilient, plastic fence mesh between the installed support posts, said mesh being capable of supporting a person when such person falls against the mesh in its vertical orientation; and c. affixing the mesh to the support posts such that the mesh is supported against the post in vertical orientation and is retained thereat despite the weight of the mesh or impact of an object at the fence structure.

7. A method as defined in claim 6, wherein the step of affixing the mesh comprises tying grid members of the mesh to the body of the support post.

* * * * *